US005762428A

United States Patent [19]

Cordery et al.

[11] Patent Number: 5,762,428

[45] Date of Patent: Jun. 9, 1998

[54] METHOD AND APPARATUS FOR SECURELY PRINTING A POSTAL INDICIA IMAGE BY DIVIDING PRINTING OF THE IMAGE IN MULTIPLE PASSES

[75] Inventors: Robert A. Cordery, Danbury; Charles F. Murphy, III, Milford, both of Conn.

[73] Assignee: Pitney Bowes Inc., Stamford, Conn.

[21] Appl. No.: 579,502

[22] Filed: Dec. 27, 1995

[51] Int. Cl.[6] ..... B41J 2/30; B41J 2/265

[52] U.S. Cl. ..... 400/124.04; 400/124.27; 101/91

[58] Field of Search ..... 101/91; 400/124.04, 400/124.05, 124.27; 395/108, 109, 110

[56] References Cited

U.S. PATENT DOCUMENTS

| | | | |
|---|---|---|---|
| 4,743,127 | 5/1988 | Uematsu | 395/108 |
| 4,809,082 | 2/1989 | Yamaguchi et al. . | |
| 4,855,752 | 8/1989 | Bergstedt . | |
| 4,967,203 | 10/1990 | Doan et al. . | |
| 4,999,646 | 3/1991 | Trask . | |
| 5,070,345 | 12/1991 | Lahut et al. . | |
| 5,330,276 | 7/1994 | Tanida | 395/108 |
| 5,347,617 | 9/1994 | Webb et al. . | |
| 5,467,709 | 11/1995 | Solomon | 101/93 |
| 5,694,526 | 12/1997 | Emmett et al. | 395/108 |

FOREIGN PATENT DOCUMENTS 56-8273 1/1981 Japan .

*Primary Examiner*—Edgar S. Burr
*Assistant Examiner*—Amanda S. Sandusky
*Attorney, Agent, or Firm*—Steven J. Shapiro; Melvin J. Scolnick

[57] ABSTRACT

A method for printing a high resolution postal indicia image includes printing with a printing mechanism a first low resolution indicia image on a mailpiece during a first pass between the printing mechanism and the mailpiece; printing with the printing mechanism a first portion of a second low resolution indicia image on the mailpiece during a second pass between the printing mechanism and the mailpiece; and printing with the printing mechanism a second portion of the second low resolution indicia image on the mailpiece during at least a third pass between the printing mechanism and the mailpiece, the second portion being complementary to the first portion to create therewith the second low resolution image, the second low resolution image being complementary to the first low resolution image to create therewith the high resolution postal indicia image. An apparatus incorporates the above method.

8 Claims, 3 Drawing Sheets

METHOD AND APPARATUS FOR SECURELY PRINTING A POSTAL INDICIA IMAGE BY DIVIDING PRINTING OF THE IMAGE IN MULTIPLE PASSES

BACKGROUND

This invention relates to printing an image with multiple passes of a printing mechanism and more particularly relates to securely printing a postal indicia image utilizing multiple passes of a printing mechanism relative to a mailpiece.

Traditional postage meters imprint an indicia on a mailpiece or a label to be subsequently placed on a mailpiece as evidence that postage has been paid. These traditional postage meters create the indicia using a platen/ink die combination or a rotary drum/impression roller combination which are moved into contact with the mailpiece to print the indicia thereon. While traditional postage meters have performed admirably over time, they are limited by the fact that if the indicia image significantly changes, a new ink die or rotary drum will have to be produced and placed in each meter. Accordingly, newer postage meters now take advantage of modern digital printing technology to overcome the deficiencies of traditional meters. The advantage of digital printing technology is that since the digital printhead is software driven, all that is required to change an indicia image is new software. Thus, the flexibility in changing indicia images or adding customized advertising slogans is significantly increased.

Modern digital printing technology includes thermal ink jet (bubble jet), piezoelectric ink jet, thermal transfer printing, and LED and laser xerographic printing which all operate to produce images in a dot-matrix pattern. In dot-matrix ink jet printing, individual print elements in the printhead such as resistors or piezoelectric elements are either electronically stimulated or not stimulated to expel or not expel, respectively, drops of ink from a reservoir onto a substrate. By controlling the timing of the energizing of each of the individual print elements in conjunction with the relative movement between the printhead and the mailpiece, a dot-matrix pattern is produced in the visual form of the desired postage indicia image.

With regard to a postage indicia, there is a need to produce an indicia image which is visually appealing and clearly readable. The indicia image must have a relatively high optical density. That is, the density of the individual dots produced by the printhead must be sufficiently high. Moreover, it is desirable that the optical density of the indicia image is sufficient enough so that the indicia image is readable using conventional optical character reader (OCR) equipment. Furthermore, when a mailpiece having an indicia image thereon is processed by, for example, the United States Postal Service (USPS), it must be detected by a conventional facer/canceler machine in order to distinguish it from both stamped mailpieces and mailpieces without a stamp or indicia thereon. The facer/canceler machine typically detects a mailpiece having an indicia by exposing the printed indicia to ultraviolet lamps and then measuring the amount of radiated light emitted back by the indicia ink. If the measured radiated light exceeds a predetermined level, the mailpiece is identified as an indicia (metered mail) and is subsequently processed to an appropriate station for further handling. It is to be noted that in the United States the indicia ink is a fluorescent ink. However, in other countries the indicia ink may be a phosphorescent ink which also emits radiated light when exposed to ultraviolet lamps such that these phosphorescent indicia can also be identified by detecting the amount of radiated light emitted therefrom. Therefore, if an indicia image is to be produced digitally in a dot-matrix pattern, the density of the individual ink dots must be sufficient to allow the fluorescence (or phosphorescence) of the indicia ink to be detected by the facer/canceler as discussed above.

In producing a dot-matrix image using a digital printhead, the individual dots in the matrix are often defined according to their relative density in two directions. That is, the dots will have a certain density (expressed as dots per inch (dpi)) in the direction of relative movement between the printing mechanism and the recording medium as well as a density in a direction perpendicular thereto, which perpendicular density is a function of the pitch (spacing) between each of the individual nozzles in the printhead. In the case of a very simple printhead having a single row of nozzles, the density of the dot-matrix pattern in the direction of relative movement between the printhead and the recording medium is dependent upon the speed of the relative movement between the printhead and the recording medium and the frequency at which the nozzles are energized. In the direction perpendicular to the relative movement, if a desired high dot density is required, the pitch between individual nozzles in the row of nozzles has to be precisely defined to result in the desired dot density. That is, the density of the nozzles themselves must be very high. As an alternative to using a printhead having a high nozzle density, a printhead could be used having two adjacent rows of nozzles that are offset from each other to obtain the desired dot density in the direction perpendicular to the relative movement of the printhead and recording medium. In this printhead configuration, the energizing timing of the nozzles in the two adjacent rows would have to be delayed relative to each other to allow individual columns of the indicia image to be created with the desired dot density. In yet another alternative, a plurality of printheads which are appropriately aligned could also be utilized to produce the desired dot density.

Each of the above-mentioned ways of producing the indicia image has serious limitations. With respect to using a single printhead having only a single row of nozzles, the complexity of producing a printhead which has the required nozzle density and is capable of printing the full height of the indicia image in a single pass of the printhead significantly drives up the cost of the printhead due to the complexity of manufacturing such a printhead which results in low manufacturing yields. In the case of using two adjacent rows of nozzles which are offset from each other, the manufacturing costs associated therewith is also relatively high and additional complexity is added to the meter electronics in order to control the delayed energizing of each of the nozzles in each of the rows to accurately produce the image without any noticeable shift in or misalignment of the indicia image. Finally, if a plurality of aligned printheads are used, the overall cost of the printing mechanism is obviously increased since two printheads are required versus one. Furthermore, as in the case of the adjacent rows of nozzles discussed above, the complexity of the electronics is increased to control the energizing sequence of the nozzles in the two printheads.

The Applicants of the instant invention have recognized the deficiencies associated with each of the above approaches, particularly with respect to producing a low cost postage meter for use in the home, small office, or home office environments. Accordingly, the Applicants embarked upon an approach to utilize a commercially available low cost printhead having a single row of nozzles which produces a relatively low dot density in the direction of the row. The low cost printhead produced the desired density indicia image by making multiple overlapping passes of the printhead. The printhead selected included a single row of 64 nozzles which when arranged transversely to the relative movement between the mailpiece and the printhead is capable of producing in a single pass a 0.8 inch high indicia at a resolution of 80 dots per inch (dpi) along the height of the indicia (perpendicular to the relative movement of the printhead and the mailpiece). However, since a greater dpi is desired along the height of the indicia image in order to ensure that it is detectable by a facer/canceler machine and preferably OCR readable, the printhead (or mailpiece) is shifted, after the first pass, along the height of the indicia such that during a second pass of the printhead a second indicia image identical to or substantially the same as the first indicia image is interlaced with the first indicia image to produce a combined indicia image having a density of 160 dpi along its height. Moreover, additional interlaced passes of the printhead can be performed in order to further increase the desired indicia height density, such as a third pass to produce a height density of 240 dpi. The shifting of the printhead along the indicia height is usually a fraction of the nozzle pitch, the fraction varying with the number of passes (½ for two passes, ⅓ for three passes, etc).

While the above solution by the Applicants allowed for the use of a low cost commercially available printhead in a postage meter for producing an indicia of an acceptable indicia height density, a potential security problem existed in that during each pass of the printhead a complete human readable indicia having an indicia height resolution of 80 dpi is produced. Thus, if three envelopes were inserted one on top of the other and then removed one at a time after each pass of the printhead, each envelope would have a readable indicia while the postage meter would only have accounted for the cost of one indicia. It is possible that despite the fact that each of these low density indicias would not be detected by the facer/canceler and would thus be appropriately routed for visual inspection by a postal worker, the quality of the indicia produced could still be mistaken as being a valid indicia during the visual inspection. Moreover, depending upon the density of the image produced during the three passes, it was also possible that each of the three images would be identified by a facer/canceler machine as a valid indicia.

In view of the above, the Applicants recognized that a more secure way of printing a desired density indicia is required which would still permit the use of commercially available low cost/low density printheads. The instant invention is directed toward the method and apparatus associated therewith.

SUMMARY OF THE INVENTION

The instant invention is directed toward a method and apparatus for securely printing an postal indicia which permits utilization of low cost printing technology. The method for printing a high resolution postal indicia image includes printing with a printing mechanism a first low resolution indicia image on a mailpiece during a first pass between the printing mechanism and the mailpiece; printing with the printing mechanism a first portion of a second low resolution indicia image on the mailpiece during a second pass between the printing mechanism and the mailpiece; and printing with the printing mechanism a second portion of the second low resolution indicia image on the mailpiece during at least a third pass between the printing mechanism and the mailpiece, the second portion being complementary to the first portion to create therewith the second low resolution image, the second low resolution image being complementary to the first low resolution image to create therewith the high resolution postal indicia image. An apparatus incorporates the above method.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
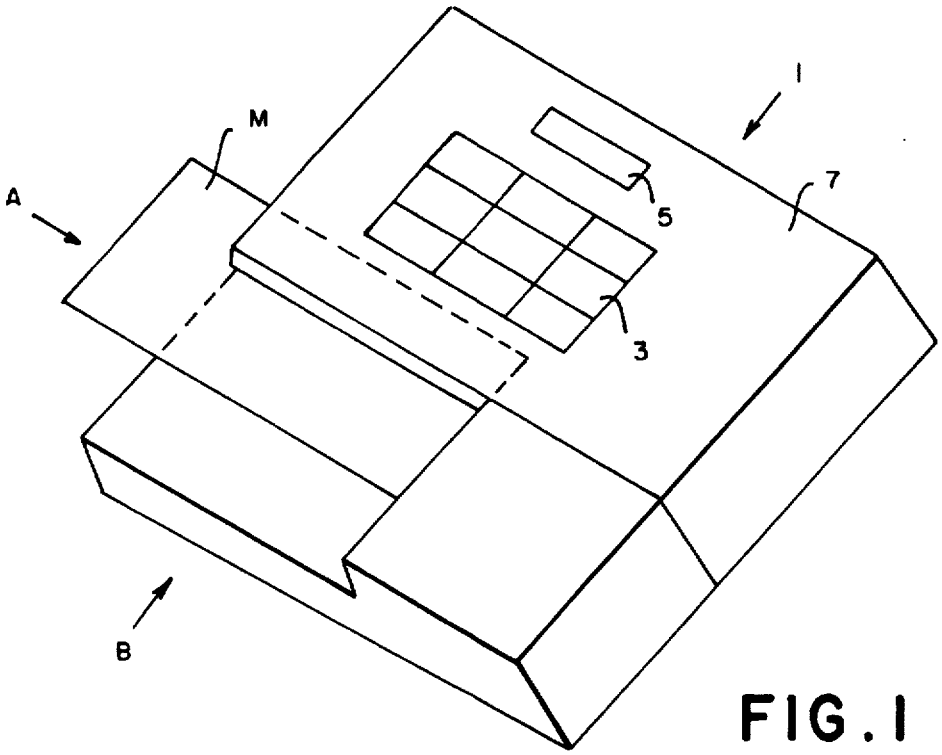
FIG. 1 is a perspective view of a postage meter incorporating the claimed invention.

Referring to FIG. 1, there is shown a new low cost postage meter 1 having a very small footprint and intended for use in the home or small business environment. Mailpieces "M" (which for the purposes of this application include envelopes, labels, flats, etc.) are fed to the postage meter 1 in either the direction of arrows "A" or "B" until a sensor (not shown), such as a microswitch, is activated by the mailpiece "M" thereby identifying the presence of the mailpiece "M". Upon identification of the mailpiece "M", a printing mechanism 9 (see FIG. 2) moves across the stationary mailpiece "M" to print the indicia image as will be discussed in more detail below. Prior to printing, the operator will have entered the postage required via individual keypad buttons 3 and the electronics in the low cost meter will have verified that a particular postage transaction is permissible. Thus, once the transaction has been authorized, detection of the mailpiece "M" by the microswitch triggers movement of the printing mechanism 9. As noted in FIG. 1, a display 5 is disposed in a top cover portion 7 of postage meter 1. The display 5 permits the postage meter 1 to visually prompt any required input by the operator and to display the operator's input which has been entered through the keypad buttons 3.

Figure 2:
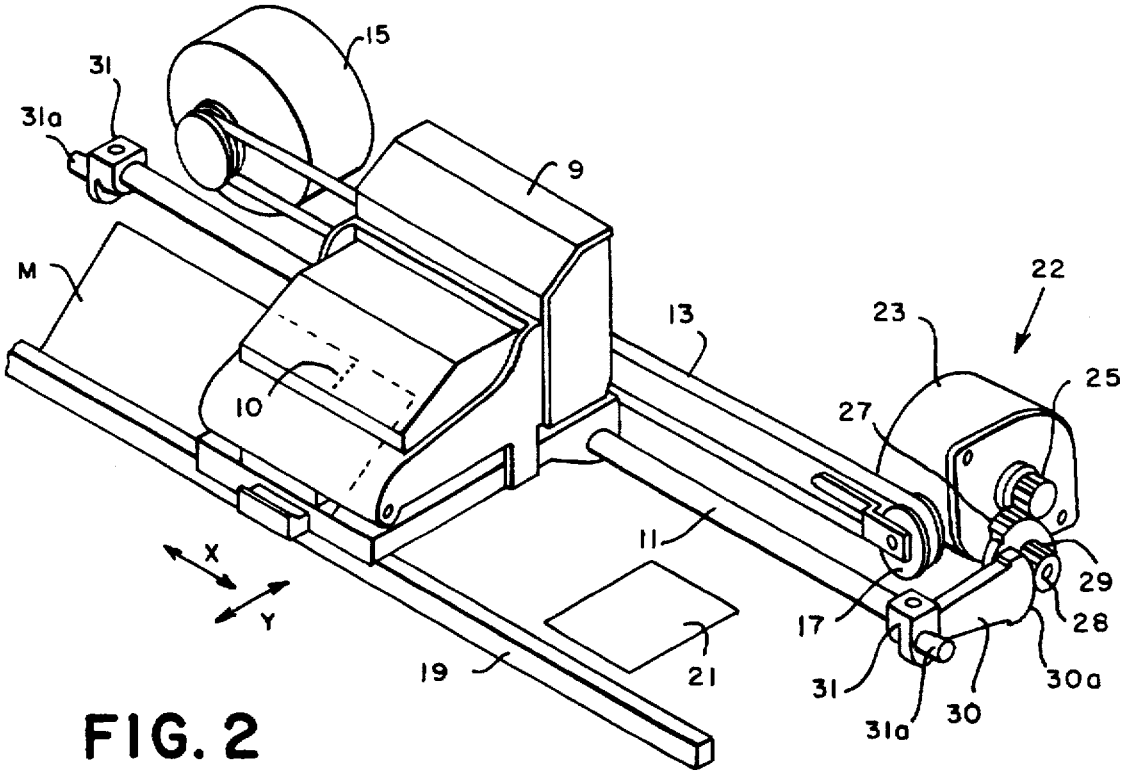
FIG. 2 is a perspective view of the structure for moving the printing mechanism within the postage meter of FIG. 1.

Regarding the movement of the printing mechanism across the mailpiece "M" reference is made to FIG. 2. FIG. 2 shows a portion of the postage meter 1 which is housed under cover 7 and which permits movement of printing mechanism 9 in the directions of arrows "X" and "Y". Printing mechanism 9 is preferably an ink jet printer having a single row of nozzles 10 arranged transversely to the direction of arrow "X". However, any dot matrix producing printer could be used. Printing mechanism 9 is rotatably mounted on a guide bar 11 and connected to an endless belt 13 driven into rotation by a motor 15. Thus, via the movement of the motor 15 and belt 13, printing mechanism 9 is capable of being moved in a reciprocating manner between the motor 15 and an idler pulley 17. Moreover, the front end of printing mechanism 9 rests on a fixed support surface 19 and slides there along. A maintenance station is shown schematically at 21. The maintenance station 21 is a conventional structure at which purging, wiping and sealing of the nozzles 10 occurs during moments of non-printing. Printing mechanism 9 is positioned at the maintenance station 21 when not being utilized for printing. Thus, when the microswitch detects the presence of the mailpiece "M" in the postage meter 1, a postage meter microcontroller 43 (see FIG. 3) controls the operation of motor 15 to move printing mechanism 9 from maintenance station 21 and across the face of mailpiece "M" to print the postage indicia thereon.

As previously discussed, and in order to make use of a printing mechanism 9 which is a low cost/low nozzle density unit, a plurality of passes of printing mechanism 9 over mailpiece "M" is required in order to produce a postage indicia image having an acceptable density in both the "X" and "Y" directions. The density of the dots in the "X" direction is easily controlled, via the microcontroller 45 (see FIG. 3), by coordinating the movement of printing mechanism 9 via motor 15 in the "X" direction together with the firing frequency of the individual nozzles 10. That is, the slower printing mechanism 9 is moved in the "X" direction for a given nozzle 10 firing frequency, the greater the dot density will be in that direction. With regard to the "Y" direction, printing mechanism 9 must be shifted in the Y direction after each pass of printing mechanism 9 in the "X" direction in order to increase the dot density of the produced indicia image along the "Y" direction.

The preferred structure for moving printing mechanism 9 in the "Y" direction is shifting mechanism 22 which includes a motor 23 operatively engaged to rotate a first gear 25 in either direction, a gear segment 27 which is intermeshed with first gear 25 and fixedly mounted on a shaft 28 that is rotatably mounted in a conventional manner in the postage meter 1, a second gear 29 fixedly mounted on shaft 28, a shift arm 30 having teeth 30*a* which are intermeshed with gear 29, and an L-shaped housing structure 31 which is mounted for rotation in a conventional manner in postage meter 1 and in which guidebar 11 is eccentrically disposed relative to the center line of a hub portion 31*a* of housing 31. In a preferred embodiment, housing 31 is a single molded component including shift arm 30. The shifting mechanism 22 works as follows. Once the first pass of printing mechanism 9 in the "X" direction is completed, and it returns to its initial position, motor 23 causes a rotation of housing 31 and shift arm 30 via the gear train 25, 27, 29 and 30*a*. The rotation of housing 31 causes a corresponding movement of guide rod 11. However, since guide rod 11 is eccentrically mounted relative to the center line of hub 31*a* (around which housing 31 is forced to rotate) it moves along an arc such that there is a movement of printing mechanism 9 predominately in the "Y" direction. The gear train is designed such that the amount of movement in the "Y" direction is a function of the spacing between the nozzles 10 and the number of passes of printing mechanism 9 to be made as previously discussed. It should be noted that since the printing mechanism 9 is free to rotate about guide rod 11 while resting on support 19, any upward or downward movement of guide rod 11 is negligible. It is also to be noted that the opposite end of guide rod 11 is mounted in an identical housing 31 which is rotatably mounted in the main side frame of postage meter 1.

Figure 3:
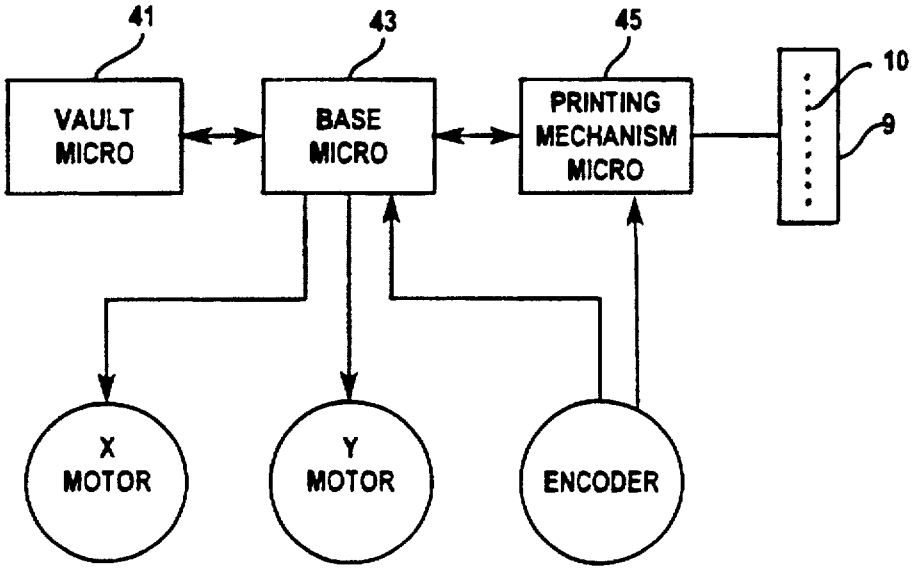
FIG. 3 is a schematic block diagram of the control system of the postage meter of FIG. 1.

While the synchronization of the moving of printing mechanism 9 with the energizing of nozzles 10 is well known in the art, a brief schematic overview of a postage meter architecture utilizing such principles is shown in FIG. 3. The postage meter 1 includes a vault microprocessor 41, a base microprocessor 43, and a printing mechanism microprocessor 45. Vault microprocessor 41 perform funds accounting, while base microprocessor 43 manages the message interaction between the operator and the postage meter 1 via display 5. In addition, base microprocessor 43 acts as a communication channel between vault microprocessor 41 and printing mechanism microprocessor 45. Postage meter 1 also includes a conventional encoder 47 which provides a signal indicating the "X" position of printing mechanism 9. The encoder signal is used by base microprocessor 43 to control operation of the motors 15, 23 and is used by printing mechanism 45 to synchronize energizing of nozzles 10 with the movement of printing mechanism 9.

Figures 4A, 4B, 4C:
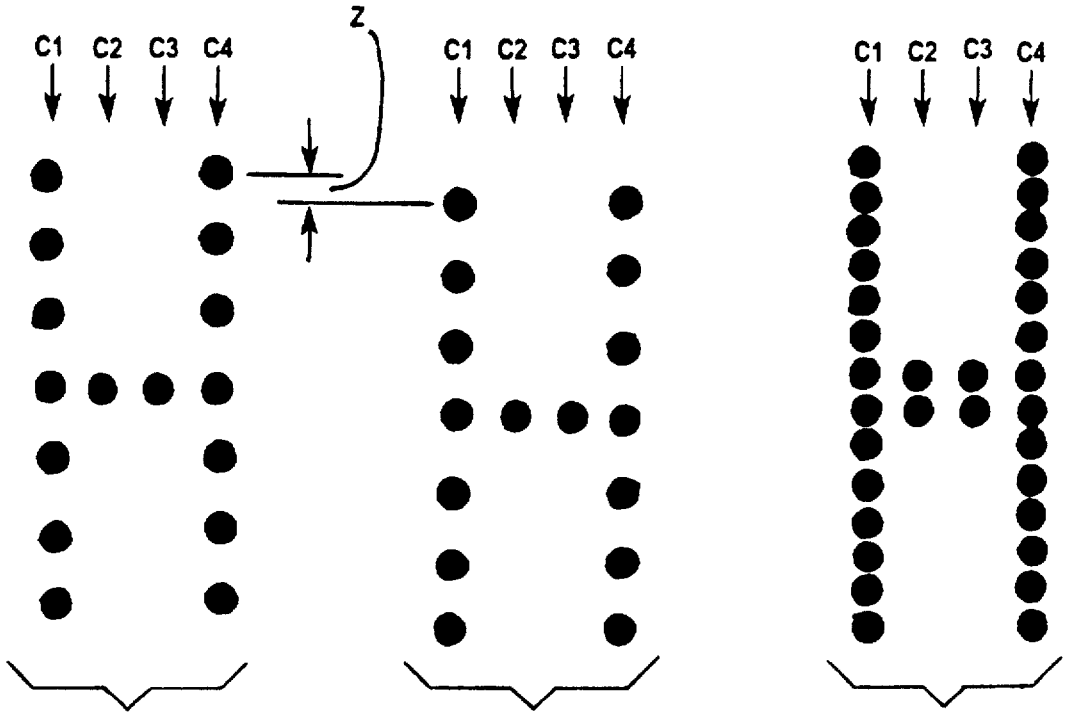
FIGS. 4(*a*), (*b*), and (*c*) together show the printing sequence of a representative indicia character.

Referring to FIGS. 4(*a*), 4(*b*) and 4(*c*) there is shown in an enlarged view the steps for printing a single letter at a desired vertical dot density utilizing a printing mechanism 9 having a low nozzle density. FIG. 4(*a*) shows the results of a single pass of printing mechanism 9 in producing the letter "H". That is, assuming printing mechanism 9 is moving from left to right in FIG. 4(*a*), it can be energized in a known manner as it moves to produce the letter "H". Assuming, for example and ease of explanation, that there is only a single row of 7 nozzles 10 in printing mechanism 9 and the speed of printing mechanism 9 has been coordinated with the frequency of firing of the nozzles 10 such that individual nozzles 10 are energized when printing mechanism 9 is at any of the column 3 positions C1, C2, C3, and C4. The letter "H" is produced by energizing all of the nozzles 10 when the printing mechanism is at column C1, energizing only the fourth or middle nozzle 10 when the printing mechanism is at columns C2 and C3 and lastly energizing all of the nozzles 10 when the printing mechanism 9 is in the position of column 3 C4. The letter "H" produced during this first pass of printing mechanism 9 has a low dot density. That is, the dots in the vertical or height direction of the letter "H" are fairly well spaced apart such that a large amount of the white background of the paper shows through. In order to improve the visual quality of the letter "H", in this example, a second pass of printing mechanism 9 is made which is complementary in nature to the first pass. That is, during a second pass of printing mechanism 9, in either the left to right or right to left directions, an identical image of the letter "H" can be produced. The only difference between the first and second letter "H" images is that during the second pass printing mechanism 9 is shifted down by ½ of the pitch of the vertical spacing between individual nozzles 10 and therefore correspondingly ½ of the spacing between the ink dots of the first image. During the second pass of printing mechanism 9 the nozzles 10 will still be controlled to be energized at columns C1, C2, C3, and C4 just as they were during the first pass such that the dot density in the direction of movement of printing mechanism 9 will not be changed. FIG. 4(*b*) shows that the letter "H" produced during the second pass is shifted by ½ the center to center vertical spacing "Z" of the dots of the first image "H". While FIGS. 4(*a*) and 4(*b*) have been shown separately to identify exactly what image is produced during each of the first and second passes of printing mechanism 9, FIG. 4(*c*) shows the finally produced image "H" which is an interlaced combination of the individual "H's" formed during the first and second passes of printing mechanism 9. It is quite clear that the finally produced image "H" has a dot density in the vertical direction which is twice as much as the vertical dot density individually produced during either the first or second passes of printing mechanism 9.

As previously stated, this procedure can be repeated for additional passes of printing mechanism 9 to further increase the dot density of the finally produced image in the vertical or height direction of the image. Thus, for example, if the finally produced H required 3 passes of printing mechanism 9, prior to the second pass printing mechanism 9 would be shifted along the height of the image by ⅓ of the pitch of the nozzles 10 and prior to the third pass printing mechanism 9 would be shifted again by ⅓ of the pitch of nozzles 10 relative to the position of printing mechanism 9 during the second pass thereof.

Figure 5:
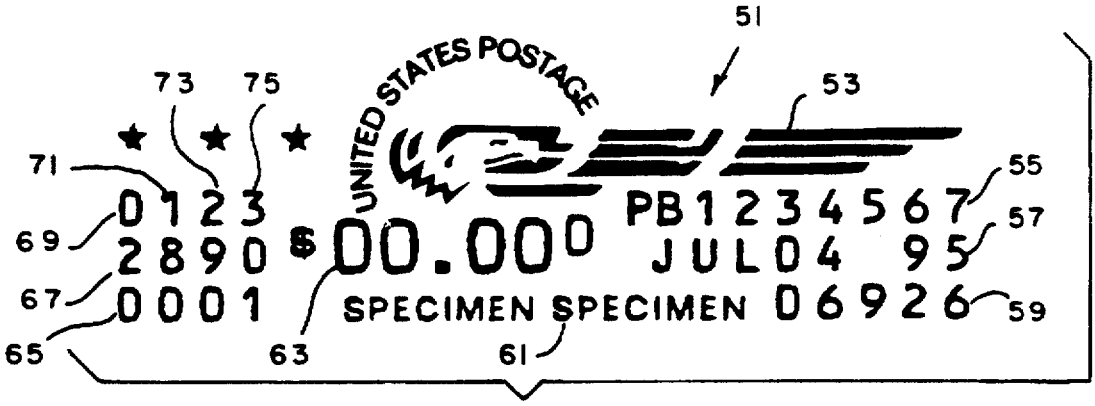
FIG. 5 shows a representative indicia produced by the method of FIG. 4.

While the above description, for simplicity, was only applied to the printing of a single letter, the Applicants have applied this basic principle to produce a full postal indicia image. FIG. 5 shows an enlarged representative example of a typical postage indicia which can be printed by postage meter 1 for use in the United States. The postage indicia 51 includes a graphical image 53 including the 3 stars in the upper left hand corner, the verbiage "UNITED STATES POSTAGE", and the eagle image; a meter identification number 55; a date of submission 57; the originating zip code 59; the originating post office 61, which for the ease of simplicity is just being shown with the words "SPECIMEN SPECIMEN"; the postage amount 63; a piece count 65; a check digits number 67; a vendor I.D. number 69; a vendor token 71; a postal token 73; and a multipass check digit 75. While most of the portions of the indicia image 51 are self explanatory, a few require a brief explanation. The vendor I.D. number identifies who the manufacturer of the meter is, the vendor token and postal token numbers are encrypted numbers which can be used by the manufacturer and post office, respectively, to verify if a valid indicia has been produced, and the multipass check digit number will be discussed in more detail below.

The FIG. 5 indicia is simply a representative example and the information contained therein will vary from country to country. In the context of this application the terms indicia and indicia image are being used to include any specific requirements of any country.

As previously mentioned, the Applicants initially utilized a 3 pass approach as described above in connection with FIG. 4 for producing the indicia 51. In their initial experiments, the Applicants utilized a printing mechanism 9 having a single column of nozzles which were capable of producing a dot density of 80 dpi. The drop size from each nozzle was approximately 50 pico liters resulting in an average ink dot size deposited on the paper of 4.2 mils in diameter. Thus, for a single column produced by the nozzles 10, approximately ⅔ of the swath area would be ink free. Therefore, to get as close as possible to producing in each column a solid line, three passes of printing mechanism 9 were made in an interlaced relationship to each other. Thus, during a single pass of printing mechanism 9 from either the right to left or left to right direction as viewed in FIG. 5, the first pass of printing mechanism 9 produced the indicia image 51 having an indicia height dot density of 80 dpi. Moreover, the movement of printing mechanism 9 was synchronized with the firing frequency of nozzles 10 to produce a density along the length of the indicia image 51 of 240 dots per inch. During the second and third passes of the printing mechanism 9 over the area covered by the indicia 51, printing mechanism 9 was shifted by ⅓ the pitch density of the nozzles 10 to produce a final indicia image 51 which was the combination of 3 interlaced full indicia images. The finally produced indicia image 51 has a height of 0.8 inches, a dot density of 240 dpi in the height direction of the indicia and a corresponding dot density of 240 dpi in the length direction. Moreover, the indicia image printed during each pass visually appears as an indicia 51 but they can either be identical or have slightly different dot patterns depending on how the final combined indicia image is required to look.

While the above method produces the indicia 51 which is capable of being read by OCR equipment as well as being detected by the facer/canceler machine, a potential security problem exists in that if someone stacked three envelopes in the postage meter 9 and pulled out one envelope after each pass of printing mechanism 9, three envelopes would be produced each having an indicia image 51 of 240 dpi by 80 dpi. While the density of these individual indicia images would not likely be detected by the facer/canceler machine or be readable by OCR equipment, a risk still exists that all 3 envelopes could be used while the postage meter 1 only accounted for printing of a single indicia. That is, even if the facer/canceler machine did not detect the indicia, the envelopes would simply be passed to another station for a visual inspection. It is quite possible that during the visual inspection the 80 by 240 dpi indicia could be considered as a valid indicia. This security risk is considered unacceptable.

The above situation created a significant problem for the Applicants in their effort to produce a low cost postage meter 1 utilizing a low cost printing mechanism having a single column of nozzles which could print a postage indicia of a desired dot density through the multiple pass technique set forth above. The alternative solutions of using multiple printheads and printheads having multiple nozzle arrays to produce the desired dot density in a single pass significantly drives up the cost of postage meter 1 defeating a major objective of producing a low cost meter 1.

Figure 6A:
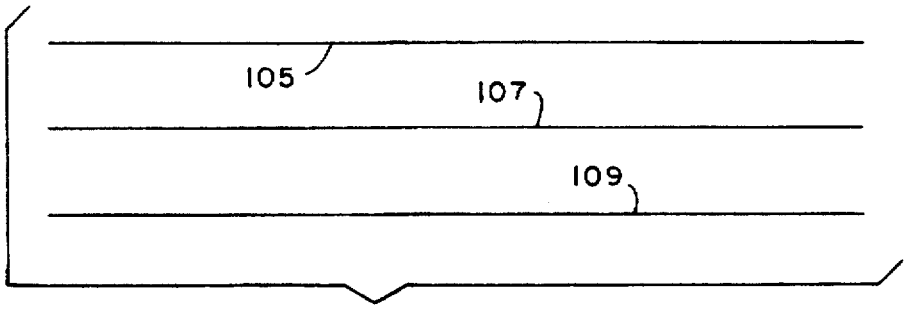
FIGS. 6(*a*) and (*b*) together show a method for printing a secure indicia.
Figure 6B:
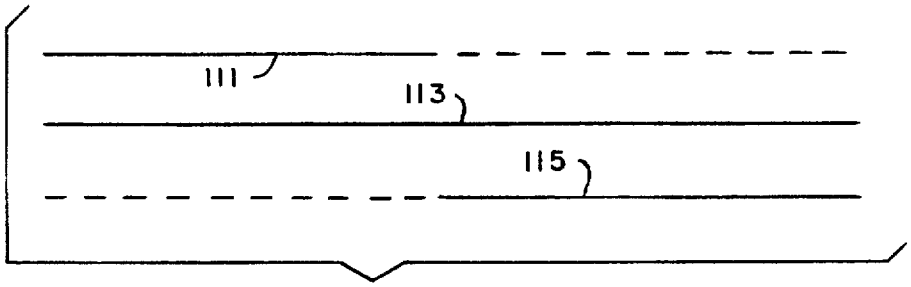
Figure 7:
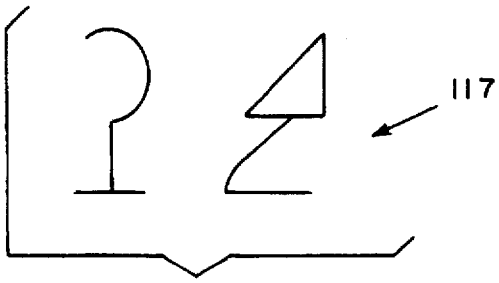
FIG. 7 shows a split indicia token.

FIGS. 6(*a*) and (*b*) show another method for printing indicia of a desired dot density which utilizes a low cost printing mechanism 9, and which deters the printing of multiple indicias while only accounting for a single indicia.

In FIG. 6(*a*) a method of producing an indicia during 3 passes of the printing mechanism 9 is shown in simplified form. Each pass of printing mechanism 9 produces a full indicia image simply represented by the straight lines 105, 107 and 109. While indicia images 105, 107 and 109 are shown separately for ease of explanation, they are shifted relative to each other along the height of the indicia as previously discussed to produce an interlaced final indicia image at a desired dot density. However, as previously discussed by simply stacking and removing envelopes a fraudulent operator could produce 3 indicias for the price of 1.

FIG. 6(*b*), shows a method for producing the postage indicia during 3 passes of printing mechanism 9 to produce an indicia of an acceptable dot density but which prevents the printing of 3 indicias by simply stacking and removing envelopes under the printing mechanism during each of the 3 passes. For simplification the images produced during each of the 3 passes are shown in FIG. 6(*b*) as either a solid line or a line consisting of a solid portion and a dash portion. For a given pass of the printhead (111, 113, 115) either a complete indicia is produced (i.e. solid line see pass number 113) or only a portion of the indicia is produced (see passes 111, 115, solid line printing, dashed line no printing). Thus, by printing only portions of the indicia during 2 of the three passes, the stacking of envelopes in the postage meter 1 and the sequential removal thereof still only produces one envelope having a full indicia and even that indicia might not be detectable by the facer/canceler machine. The envelopes which are individually printed on during the first 111 and third passes 115 only produce one-half of an indicia thereby preventing someone from obtaining multiple indicias while only paying for a single indicia.

To further secure the printing operation described above in connection with the method of FIG. 6(*b*), it is desirable to randomize which portions of the indicia will be printed during each of the 3 passes. For example, in FIG. (*b*) printing mechanism 9 prints only the left one-half of the indicia during the first pass, a full indicia during the second pass and only the right one-half of the indicia during the third pass. Moreover, prior to the third pass, the printing mechanism 9 is shifted so that the third pass is virtually horizontally aligned with the first pass. However, if a fraudulent operator were to recognize this sequence of operation he could, for example, produce 4 indicia for the price of two by quickly removing and inserting envelopes during two sequential postage operations. That is, if an envelope having only the left one-half of the indicia is inserted into the postage meter during the third pass 115 of printing mechanism 9 during generation of a subsequent indicia, a complete indicia would be produced. Likewise, the complementary pass of the indicia produced by the third pass 115 of the printing mechanism 9 by the first postage operation could be combined with the image produced during the first pass 111 of the printing mechanism 9 for the next postage operation resulting in another full indicia. Taken together with the two complete indicias produced during the second pass of printing mechanism 9 for each postage transaction results in 4 indicia being produced for the cost of 2. While it is possible that none of the individual indicia printed would be of a sufficient dpi be detected by the facer/canceler, there is still the possibility that they would pass as valid indicia during a visual inspection.

In order to overcome the potential problem set forth above, the printing mechanism microcontroller 45 of postage meter 1 includes a program to randomize the sequence of which portions of the indicia are printed during each of the 3 passes for a single postage transaction. Thus, for example, while during a first postage transaction the printing sequence will be as set forth in FIG. 6(*b*) above, during the very next postage transaction the printing sequence could very well be in the reverse order (i.e. 115, 113, 111 versus 111, 113, 115). This randomization of the printing sequence eliminates the predictability of the printing sequence and makes it extremely difficult for an operator to create a greater number of indicia images than is accounted for. To even further preclude the printing of a multiplicity of unpaid for indicias, the microcontroller 45 can also be programmed to not only randomize the sequence of printing but to actually randomize within the different passes the graphics and numerics that are being produced during each pass. In its simplest form, instead of having a full indicia produced and 2 one-half indicias produced as is the case during a first postage transaction, during a second postage transaction, perhaps a full indicia is produced during one pass, ⅓ of an indicia is produced during a second pass, and ⅔ of an indicia is produced during a third pass.

In order to further prevent the operator from printing on 3 separate envelopes during the first postage operation and then using those envelopes during a second postage meter printing operation to obtain a multiplicity of indicias which are not accounted for, the digital tokens 71 and 73 (see FIG. 5) which will be different for each printed indicia can be produced during two of the 3 passes of the indicia. That is, the tokens can be produced in two parts, with one part produced, for example, during the first pass 111 and a second part produced during the third pass 115. By splitting the digital token in this manner, if a user were to remove an envelope after each pass and change the envelope order during the next metering operation to fill in the unprinted token areas, the tokens in the second printing operation would be different and therefore the printing of tokens would be split with the top half of a line of tokens being one number and the bottom half of the same line being a different number. The digital tokens could possibly look like the split number shown in FIG. 13, where the top half represent numbers 3 and 4 and the bottom half represents numbers 1 and 2. The split number 117 would be easily recognized by a postal worker as a way of identifying an invalid indicia.

What is claimed is:

1. A method for printing a high resolution postal indicia image comprising the steps of:

A) printing with a printing mechanism a first low resolution postal indicia image on a mailpiece during a first pass between the printing mechanism and the mailpiece;

B) printing with the printing mechanism a first portion of a second low resolution postal indicia image on the mailpiece during a second pass between the printing mechanism and the mailpiece; and C) printing with the printing mechanism a second portion of the second low resolution postal indicia image on the mailpiece during at least a third pass between the printing mechanism and the mailpiece, the second portion being complementary to the first portion to create therewith the second low resolution postal indicia image, the second low resolution postal indicia image being complementary to the first low resolution image to create therewith the high resolution postal indicia image and wherein the first and second low resolution postal indicia images are printed in an overlapping manner and the first and second portions are printed adjacent to each other in a non-overlapping manner.

2. A method as recited in claim 1, wherein the printing mechanism includes a single row of nozzles which when energized at the same time print at a predetermined dot density in a direction of the single row, and the high resolution postal indicia image has a dot density in the direction of the single row which is greater than the predetermined dot density.

3. A method as recited in claim 1, wherein the high resolution postal indicia image includes encrypted data, and a first part of the encrypted data is printed during one of the first, second and third passes and a second part of the encrypted data is printed during a different one of the first, second, and third passes, the first and second parts forming the encrypted data.

4. A method as recited in claim 1, further comprising randomizing the sequence of steps A), B) and C) for a subsequent postage transaction to produce the high resolution postal indicia on a second mailpiece.

5. An apparatus for printing a high resolution postal indicia image on a mailpiece during a postage transaction, the apparatus comprising:

a printing mechanism mounted for relative movement between the mailpiece and the printing mechanism;

means for controlling the printing mechanism to print 1) a first low resolution postal indicia image on the mailpiece during a first pass between the printing mechanism and the mailpiece, 2) a first portion of a second low resolution postal indicia image on the mailpiece during a second pass between the printing mechanism and the mailpiece, and 3) a second portion of the second low resolution postal indicia image on the mailpiece during at least a third pass between the printing mechanism and the mailpiece, the second portion being complementary to the first portion to create therewith the second low resolution postal indicia image, the second low resolution postal indicia image being complementary to the first low resolution postal indicia image to create therewith the high resolution postal indicia image with the first and second low resolution postal indicia images are printed in an overlapping manner and the first and second portions printed adjacent to each other in a non-overlapping manner.

6. An apparatus as recited in claim 5, wherein the controlling means includes means for randomizing the sequence of printing of the first low resolution postal indicia image, the first portion, and the second portion for subsequent postage transactions.

7. An apparatus as recited in claim 5 wherein the printing mechanism is an ink jet printer.

8. An apparatus as recited in claim 7 wherein the controlling means controls shifting of the printing mechanism in a direction transverse to a direction of the first pass so that the second and third passes are offset from the first pass.

* * * * *